United States Patent [19]

Ringgenberg

[11] Patent Number: 4,619,319

[45] Date of Patent: Oct. 28, 1986

[54] PACKER AND ACTUATION PORTION OF TUBING CONVEYED COMPLETION SYSTEM

[75] Inventor: Paul D. Ringgenberg, Duncan, Okla.

[73] Assignee: Halliburton Company, Duncan, Okla.

[21] Appl. No.: 697,604

[22] Filed: Feb. 1, 1985

[51] Int. Cl.[4] ..... E21B 33/129; E21B 43/116

[52] U.S. Cl. ..... 166/55.1; 166/129; 166/138; 175/4.52; 175/4.54

[58] Field of Search ..... 175/4.52, 4.54, 4.56; 166/55.1, 297, 129, 131, 118, 133, 138, 183, 188; 102/319-321; 89/1 C

[56] References Cited

U.S. PATENT DOCUMENTS

| | | | |
|---|---|---|---|
| 2,760,408 | 8/1956 | Taylor | 175/4.54 |
| 2,866,508 | 12/1958 | Church | 175/4.52 |
| 3,011,551 | 12/1961 | Young et al. | 166/55.1 |
| 3,040,808 | 6/1962 | Schramm et al. | 175/4.52 |
| 3,189,094 | 6/1965 | Hyde | 166/55.1 |
| 3,338,308 | 8/1967 | Elliston et al. | 166/138 |
| 3,387,658 | 6/1968 | Lebourg | 166/129 |
| 3,800,705 | 4/1974 | Tamplen | 175/4.54 |
| 4,531,590 | 7/1985 | Peterson | 175/4.52 |
| 4,560,000 | 12/1985 | Upchurch | 166/55.1 |
| 4,564,076 | 1/1986 | Vann et al. | 166/55.1 |
| 4,566,538 | 1/1986 | Peterson | 166/278 |

OTHER PUBLICATIONS

The brochure entitled "Flopetrol Johnson Tubing Conveyed Perforating Systems" by Schlumberger, issued Jul., 1983.

*Primary Examiner*—James A. Leppink
*Assistant Examiner*—Hoang C. Dang
*Attorney, Agent, or Firm*—James R. Duzan

[57] ABSTRACT

A packer portion and actuating portion for a tubing conveyed well perforating system used for the completion of formations for both testing and production which system may be actuated either mechanically by a sinker drop bar or hydraulically by pressure in the annulus between the well bore and tubing string above the packer portion located in tubing string.

15 Claims, 11 Drawing Figures

PACKER AND ACTUATION PORTION OF TUBING CONVEYED COMPLETION SYSTEM

BACKGROUND OF THE INVENTION

This invention relates to perforating systems in general and, more specifically, to the packer, port, and actuation portions of a tubing conveyed well perforating system which may be actuated either mechanically or hydraulically.

In completing well bores, it is desirable to use a large diameter casing-type gun to effeciently perforate the casing and form passageways which extend into the formation through which formation fluids may flow into the casing. In many instances where it is desired to perforate long intervals of the formation, a series of sequentially connected perforating guns are run into a cased well bore on the end of a tubing string. In some instances, it may be desirable to isolate the formation during the perforating operation to minimize contamination of the formation by fluids in the casing and to subject the formation to a reduced pressure (below formation pressure) to encourage the rapid flow of formation fluid into the casing, after perforation of the casing, to attempt to wash or clean the perforations.

To accomplish the isolation of the formation from the fluids in the casing the perforating guns may be sequentially connected below a packer having a perforated nipple connected to the bottom thereof. When the string of perforating guns is connected below a packer having a perforated nipple connected to the bottom thereof, since the pressure in the well bore below the packer may be reduced by the control of the level of fluid in the tubing string used to convey the packer and perforating gun, a large pressure differential may exist between the interior of the perforated casing and the formation surrounding the perforated casing which may facilitate the formation fluids flowing into the casing washing or cleaning the perforations.

In some instances, when using tubing conveyed perforating guns, it may be desired to use a sinker bar having a firing mechanism attached thereto to actuate the perforating guns. Typically, when using a sinker bar to actuate a string of perforating guns, detonation of the guns is usually accomplished from the top gun of the series when the sinker bar detonates a primer cord explosive in the top gun which, in turn, detonates the shaped charges in the perforating guns.

Examples of tubing conveyed perforating guns are shown in U.S. Pat. Nos. 2,169,559; 2,530,966; 2,745,495; 3,011,551; and 3,291,207 while examples of tubing conveyed perforating guns which are actuated through the use of sinker bars are shown in U.S. Pat. Nos. 2,456,977; 2,760,408; and 3,706,344 as well as U.S. patent application Ser. No. 515,821; filed July 21, 1983.

STATEMENT OF THE INVENTION

The present invention is directed to the packer, port, and actuation portions of an improved tubing conveyed well perforating system of the type shown in U.S. Pat. No. 2,169,559. More specifically, the packer portion and actuation portion of a tubing conveyed well perforating system used for the completion of formations for both testing and production which system may be actuated either mechanically by a sinker drop bar or hydraulically by pressure in the annulus between the well bore and tubing string above the packer portion located in tubing string.

DETAILED DESCRIPTION OF THE INVENTION

Figure 1:
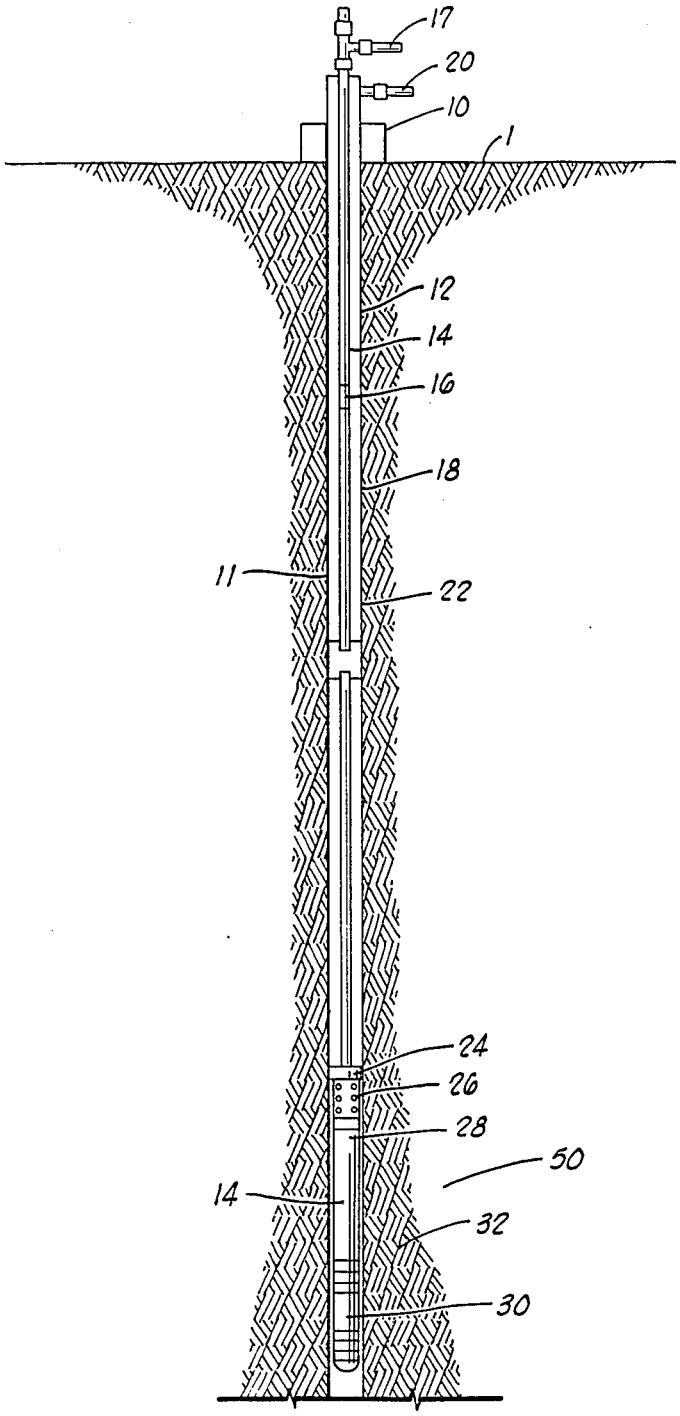
FIG. 1 is a view of the cross-section of the earth's surface having a borehole formed therein which has, in turn, a tubing conveyed perforation system which includes the present invention, shown schematically, there.

Referring to FIG. 1, the tubing conveyed completion system of the present invention is shown in a well bore.

The wellhead 10 is situated above the surface of the earth 1 and is connected to a casing 12 installed in a wellbore 11 through which tubing 14 is disposed forming an inner flow path 16 and an annular flow path 18 between the exterior of the tubing 14 and the interior of the casing 12.

The annular flow path 18 is connected to outlet 20 through which the flow of fluids into and from the flow path 18 may be controlled.

Typically, the casing 12 will be cemented into the earth 1 having an annular coating of cement 22 therearound and any voids between the casing 12 and well bore 11 in the earth filled with cement.

Connected to the lower end of tubing string 13 is the tubing conveyed completion system 50 of the present invention. The tubing conveyed completion system 50 of the present invention comprises a packer portion 24 used to seal the interior of the casing 12 so that one portion of the well bore 11 may be isolated from another, port assembly portion 26 releasably connected to the packer portion 24, actuating assembly portion 28 including a firing head actuating assembly and firing head assembly releasably connected to the port assembly portion 26 and a perforating gun or jet perforating device 30 used to form perforations in the casing 12, annular cement coating 22 surrounding the casing 12 and in the earth 1 surrounding the well bore 11. The perforating gun may be any type which will provide communication between a hydrocarbon bearing formation 32 and the well bore 11.

Figure 2A:
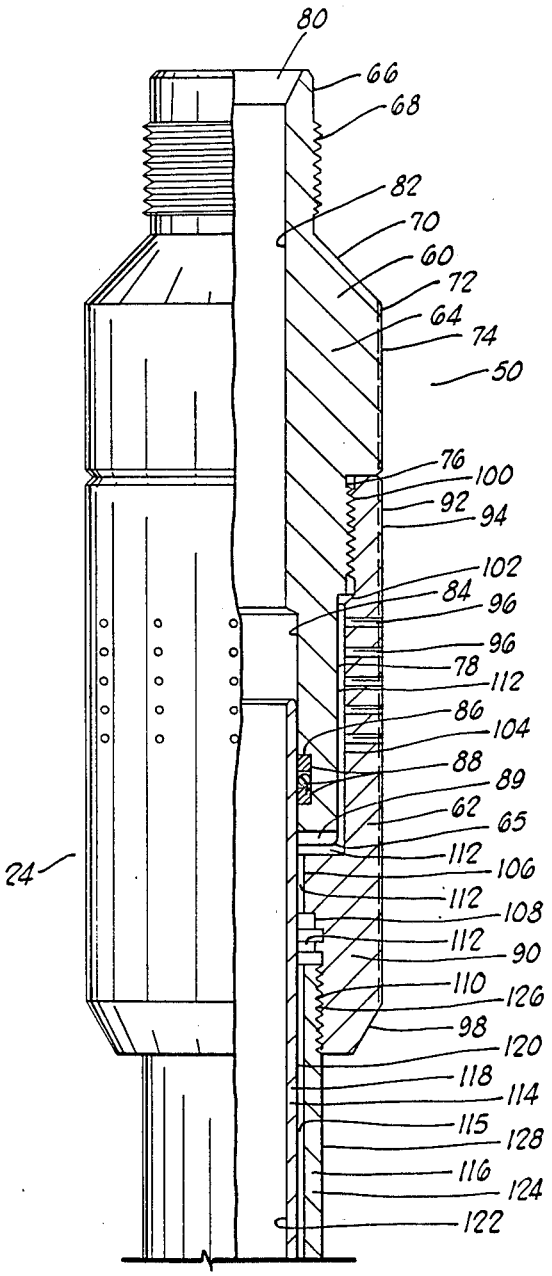
FIGS. 2A through 2H are partial cross-sectional views of the tubing conveyed completion system of the present invention.

Referring to FIG. 2A, the nipple 60 and coupling 62 of the packer portion 24 are shown.

The nipple 60 comprises an annular elongated cylindrical member having, on the exterior thereof, first cylindrical surface 66, first threaded portion 68, frusto-conical surface 70, second cylindrical surface 72 having, in turn, a plurality of wrenching flats 74 therein, second threaded portion 76, and third cylindrical surface 78, and, on the interior thereof, frusto-conical surface 80, first cylindrical bore 82 and second cylindrical bore 84 having, in turn, annular groove 86 therein containing annular seal means 88 therein. A plurality of slots or channels 89 are formed on the end 65 of the annular elongated cylindrical member.

The coupling 62 comprises an annular elongated cylindrical member having, on the exterior thereof, cylindrical surface 92 having, in turn, a plurality of wrenching flats 94 therein and a plurality of apertures 96 therein extending through the cylindrical member from the exterior to the interior thereof and a frusto-conical surface 98 and, on the interior thereof, first threaded bore 100 which releasably, threadedly engages second threaded portion 76 of nipple 60, annular chamfered surface 102, first cylindrical bore 104, second cylindrical bore 106, third cylindrical bore 108 and second threaded bore 110.

When nipple 60 and coupling 62 are assembled, an annular cavity 112 is present between the two, which extends around end 65 of nipple 60.

Further shown in FIG. 1 are the upper portions of inner packer portion mandrel 114 and upper packer mandrel 116.

A portion of the exterior surface 120 inner packer portion mandrel 114 slidably, sealingly engages seal means 88 in nipple 60 and is received within bore 84 therein.

First threaded portion 126 of upper packer mandrel 116 releasably, threadedly engages second threaded bore 110 of coupling 62.

Referring to FIGS. 2A through 2E, the inner packer portion mandrel 114 comprises an annular elongated cylindrical member having a cylindrical exterior surface 120 and cylindrical bore 122.

Figure 2B:
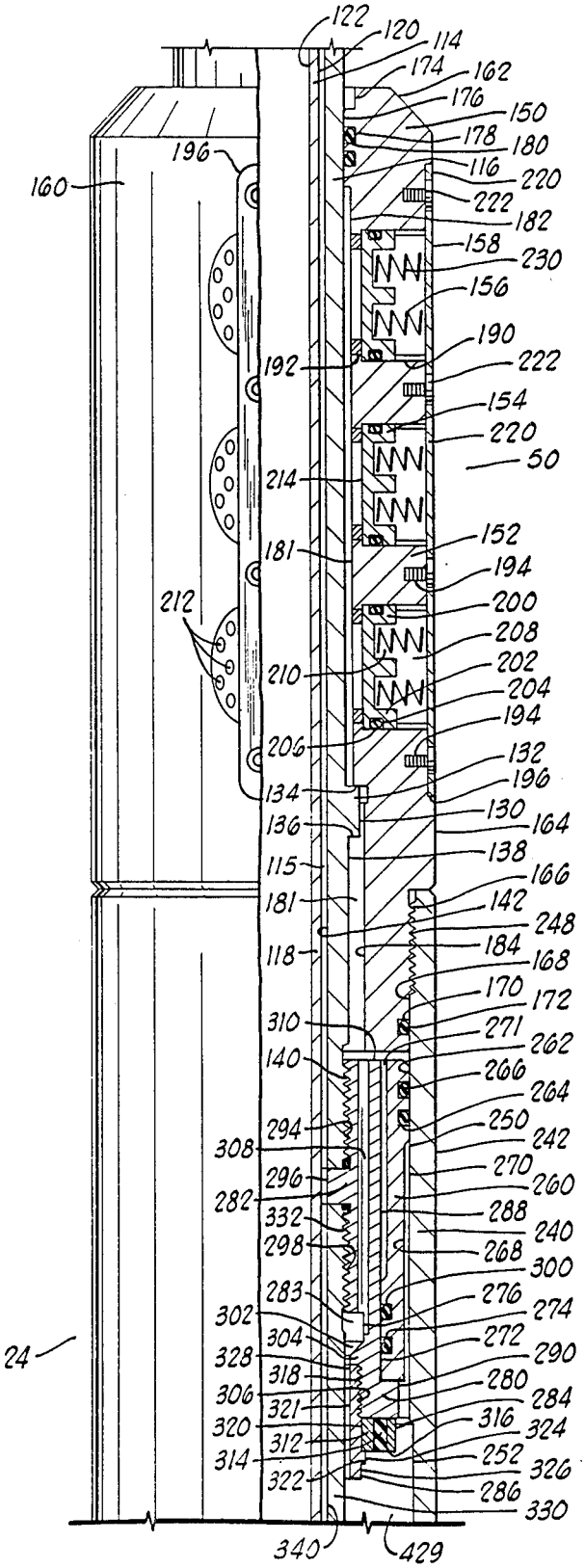

Referring to FIGS. 2A and 2B, mandrel 116 comprises an annular elongated cylindrical member having, on the exterior thereof, first threaded portion 126, first cylindrical surface 128, second cylindrical surface 130 forming annular rib 132 having, in turn, upper shoulder 134 and lower shoulder 136 thereon, third cylindrical surface 138 and second threaded portion 140, and, on the interior, cylindrical bore 142 therethrough.

Referring to FIG. 2B, the hydraulic slip assembly 150 comprises hydraulic slip body 152, a plurality of hydraulic slips 154 retained within body 152, a plurality of hydraulic slip retractor springs 156 biasing the plurality of slips 154 in a retracted position within body 152 and a plurality of hydraulic slip hold down straps 158 retaining the springs 156 in the slips 154.

The hydraulic slip body 152 comprises an annular elongated cylindrical member 160 having, on the exterior thereof, annular frusto-conical surface 162, first cylindrical surface 164, threaded portion 166, and second cylindrical surface 168 having, in turn, annular recess 170 therein containing seal means 172 therein and, on the interior thereof, first cylindrical bore 174, second cylindrical bore 176 having, in turn, annular recesses 178 therein containing seal means 180 therein which slidingly, sealingly engage first cylindrical surface 128 of upper packer mandrel 116, third cylindrical bore 182, and fourth cylindrical bore 184.

The hydraulic slip body 152 further comprises a plurality of first bores 190 and second bores 192 having, in turn, a diameter smaller than first bores 190 extending through the body 152 from the first cylindrical surface 164 to third cylindrical bore 182, a plurality of threaded apertures 194 extending partially through body 152, and a plurality of elongated recesses 196 extending over each first bore 190 in the body 152.

Retained within each first bore 190 in the hydraulic slip body 152 is a cylindrical hydraulic slip 200. Each hydraulic slip 200 comprises a cylindrical member 202 having an annular recess 204, in the exterior thereof having, in turn, annular elastomeric seal 206 therein, an elongated slot 208 extending through a portion thereof, a plurality of recesses 210 therein, and a plurality of teeth 212 thereon. The bottom 214 of each hydraulic slip 200 is in fluid communication with the third cylindrical bore 182 of hydraulic slip body 152 via second bore 192 in the body 152.

Each hydraulic hold down strap 158 comprises an elongated, generally rectangular in cross-section member having a width such that the member is received within elongated recess 196 in body 152 and such that the elongated slot 208 in each slip 200 is wider than the width of member 86, and having a plurality of bores 220 therethrough. Each strap 158 is releasably secured to hydraulic slip body 152 by a plurality of threaded fasteners 222, each fastener having the head received within bore 220 of strap 158 and the body engaging a threaded aperture 194 in body 152.

The hydraulic slip retractor springs 156 each comprise a coil wound type spring member 230 having one end 232 thereof retained within a circular recess 210 in slip 200 and the other end abutting strap 158 having a recess therein (not shown) for the end of spring 230.

Figure 2C:
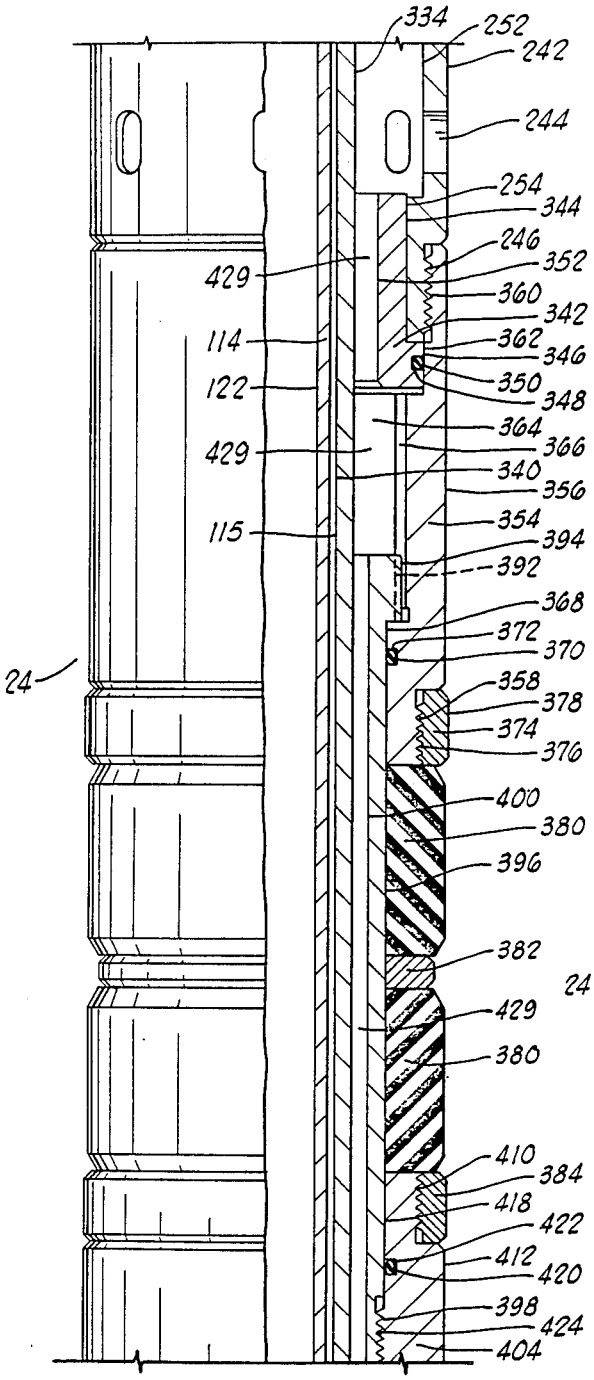

Referring to FIGS. 2B and 2C, the bypass case 240 is shown. The bypass case 240 comprises an annular elongated member having, on the exterior thereof cylindrical surface 242 having, in turn, a plurality of apertures 244 therein extending through the case 240 from the exterior to the interior thereof, and a threaded portion 246 and, on the interior thereof, a threaded bore 248, first cylindrical bore 250, second cylindrical bore 252, and third cylindrical bore 254.

Referring to FIG. 2B, the floating piston 260 comprises an annular elongated member having, on the exterior thereof, first cylindrical surface 262 having, in turn, annular recesses 264 therein containing elastomeric seal means 266 therein slidingly, sealingly engaging first bore 250 of bypass case 240 and second cylindrical surface 268 and, on the interior thereof, first cylindrical bore 270 having, in turn, a frusto-conical shoulder 271 on one end thereof and second cylindrical bore 272 having, in turn, annular recesses 274 therein containing seal means 276 therein.

The balancing coupling assembly 280 comprises balancing coupling body 282, seal 284, and seal retainer 286.

The balancing coupling body 282 comprises an annular elongated cylindrical member having, on the exterior thereof, first cylindrical surface 288 and second cylindrical surface 290 and, on the interior thereof, first threaded bore 292 which releasably, threadedly engages threaded surface 140 of the upper packer mandrel 116, first cylindrical bore 296, second threaded bore 298, second cylindrical bore 300, frusto-conical annular surface 302, third cylindrical bore 304, and third threaded surface 306. The balancing coupling body 282 further includes a plurality of axial passageways 308 extending from end 310 thereof and terminating in second cylindrical bore 300.

The seal 284 comprises a first annular member 312, annular elastomeric member 314 having the interior thereof secured to the exterior of first member 312, and second annular member 316 having the interior thereof secured to the exterior annular elastomeric member 314.

The seal retainer 286 comprises an annular elongated cylindrical member having, on the exterior thereof, threaded surface 318 which releasably, threadedly engages second threaded bore 298 of body 282, first cylindrical surface 320, annular rib 322 having second cylindrical surface 324 on the exterior thereof and the upper surface thereof abutting the bottom of seal 284, and fourth cylindrical surface 326 and, on the interior thereof, cylindrical bore 328 therethrough.

Referring again to FIGS. 2B, 2C and 2D, the center mandrel 330 comprises an annular elongated cylindrical member having, on the exterior thereof, first threaded portion 332 which releasably, threadedly engages second threaded bore 298 of body 282, first cylindrical surface 334, second threaded portion 336 and second cylindrical portion 338 and, on the interior thereof, cylindrical bore 340.

Referring to FIG. 2C, the face seal sleeve 342 comprises an annular elongated cylindrical member having, on the exterior thereof, first cylindrical surface 344 and second cylindrical surface 346 having, in turn, annular recess 348 therein containing seal means 350 therein and, on the interior thereof, cylindrical bore 352 therethrough.

The upper shoe 354 comprises an annular elongated cylindrical member having, on the exterior thereof, cylindrical surface 356 and threaded portion 358 and, on the interior thereof, threaded bore 360, first cylindrical bore 362 which sealingly engages seal means 350 in face seal sleeve 342, second cylindrical bore 364 having, in turn, a plurality of axial recesses 366 therein, and third cylindrical bore 368 having, in turn, annular recess 370 therein containing seal means 372 therein.

The upper back-up ring 374 comprises an annular cylindrical member having, on the exterior thereof, cylindrical surface 378 and, on the interior thereof, a threaded bore 376 therethrough which releasably, threadedly engages threaded portion 358 of upper shoe 356.

The packer elements 380 each comprise annular elastomeric members having a cylindrical exterior surface and bore therethrough.

The packer element spacer 382 comprises an annular cylindrical member having, on the exterior thereof, a cylindrical surface and, on the interior thereof, a cylindrical bore therethrough.

The lower back-up ring 384 is similar in construction to upper back-up ring 374.

Figure 2D:
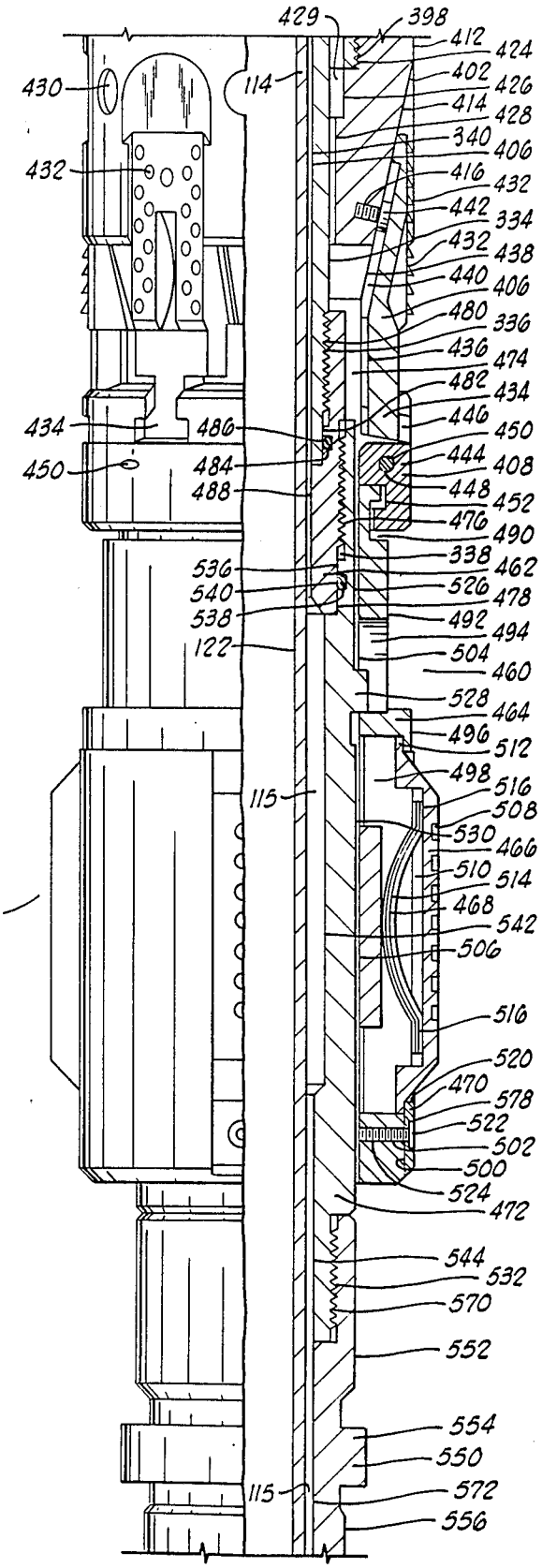

Referring to FIGS. 2C and 2D, the packer mandrel 390 comprises an annular elongated cylindrical member having, on the exterior thereof, cylindrical surface 392 having, in turn, a plurality of axial lugs 394 thereon which slidingly, sealingly engage axial recesses 366 in upper shoe 354, second cylindrical surface 396, and threaded portion 398 and, on the interior thereof, cylindrical bore 400 therethrough.

The mechanical slip body assembly 402 comprises slip body 404, mechanical slips 406 and split ring retainer 408.

The slip body 404 comprises an annular elongated cylindrical member having, on the exterior thereof, threaded portion 410 which releasably, threadedly engages the threaded bore of lower back-up ring 384, cylindrical surface 412 having, in turn, a plurality of frusto-conical surfaces 414 therein, each surface 414 having a threaded aperture 416 therein and, on the interior thereof, first cylindrical bore 418 having, in turn, annular recess 420 therein containing seal means 422 therein, threaded bore 424 which releasably, threadedly engages threaded portion 398 of packer mandrel 390, second cylindrical bore 426, and third cylindrical bore 428. The slip body 404 further includes a plurality of apertures 430 therethrough to allow fluid communication from the exterior of the slip body 404 to the interior thereof.

The mechanical slips 406 each comprise an elongated member having a plurality of teeth 432 on the exterior thereof, a T-shaped lug 434 on one end thereof, a arcuate surface 436 on the interior side thereof, and a frusto-conical surface 438 which slidably mates with frusto-conical surfaces 414 of slip body 404 having, in turn, annular recess 440 which slidably receives the head of threaded member 442 therein which has the body thereof releasably, threadedly retained in aperture 416 of slip body 404.

The split ring retainer 404 comprises a plurality of cylindrical, annular segments 444, each segment 444 having a plurality of T-shaped apertures 446 therein each receiving the T-shaped lug 434 of slip 406 therein, threaded aperture 448 therein which receives threaded member 450 which releasably secures one segment 444 to the next, and annular recess 452 therein.

The drag block assembly 460 comprises adapter 462, drag block sleeve 464, drag blocks 466, drag block springs 468, drag block keeper 470, and lower mandrel 472.

The adapter 462 comprises an annular elongated cylindrical member having, on the exterior thereof, first cylindrical surface 474, threaded portion 476 and second cylindrical surface 478 and, on the interior thereof, threaded bore 480 which releasably, threadedly engages second threaded portion 336 of center mandrel 330, first cylindrical bore 482 having, in turn, annular recess 484 therein containing seal means 486 therein and second cylindrical bore 488.

The drag block sleeve 464 comprises an annular elongated annular member having, on the exterior thereof, annular recess 490 which receives a portion of one end of each annular segment 444 of the split ring retainer 404 therein, first cylindrical surface 492 having, in turn, automatic J-shaped aperture 494 therein, second cylindrical surface 496 having, in turn, a plurality of apertures 498 therein, third cylindrical surface 497 and fourth cylindrical surface 500 having, in turn, a plurality of threaded apertures 502 therein and, on the interior thereof, first cylindrical bore 504 and second cylindrical bore 506, the bores 504 and 506 containing a portion of the long portion of the J-shaped aperture 494 therein.

Each drag block 466 comprises an elongated member having, on the exterior thereof, teeth 508 and, on the interior thereof, recess 510. One end 512 of each drag block 466 is retained within a portion of recess 498 in the drag block sleeve 464.

Each drag block spring 468 comprises an elongated resilient member having a bow portion 514 which abuts third cylindrical surface 497 of drag block sleeve 464 and end portions 516 which are received in recess 510 each drag block 466 abutting the interior thereof.

Each drag block keeper 470 comprises an arcuate shaped member having an aperture 518 therein and an end portion 520 extending over an end of each drag block 466 to retain the block 466 in drag block sleeve 464. Each drag block keeper 470 is releasably retained on drag block sleeve 464 by means of threaded fastener 522 which has the threaded portion 524 thereof releasably, threadedly received in aperture 502 in drag block sleeve 464.

The lower mandrel 472 comprises an annular elongated annular member having, on the exterior thereof, first cylindrical surface 526, lug 528 which engages J-shaped aperture 494 in drag block sleeve 464, second cylindrical surface 530 and threaded portion 532 and, on the interior thereof, threaded bore 534 which releasably, threadedly receives threaded portion 476 of adapter 462 therein, first cylindrical bore 536 having, in turn, annular recess 538 therein containing seal means 540 therein, second cylindrical bore 542 and third cylindrical bore 544.

Figure 2E:
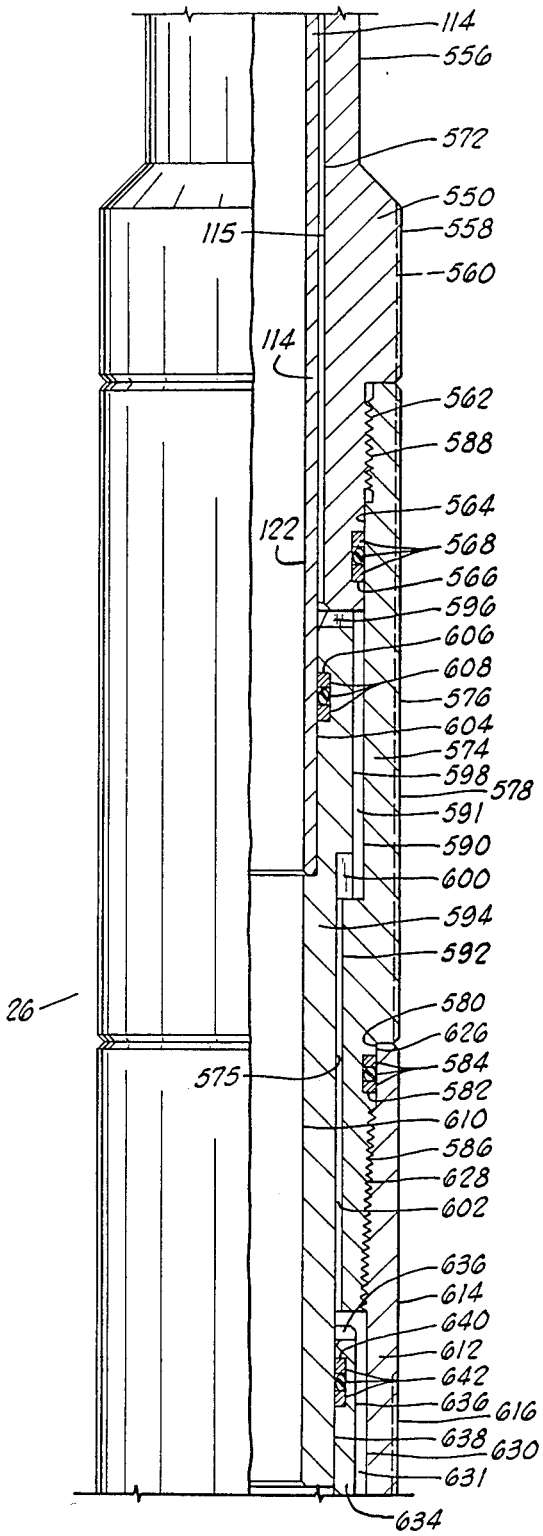

Referring to FIGS. 2D and 2E, the lower lug mandrel 550 comprises an elongated annular cylindrical member having, on the exterior thereof, first cylindrical surface 552, annular lug 554 having, in turn, annular recesses on either side thereof, second cylindrical surface 556, third cylindrical surface 558 having, in turn, a plurality of wrenching flats 560 therein, threaded portion 562, and fourth cylindrical surface 564 having, in turn, annular recess 566 therein containing seal means 568 therein and, on the interior thereof, threaded bore 570 which releasably, threadedly engages threaded portion 532 of lower mandrel 472 and cylindrical bore 572.

Referring to FIG. 2E, the lower adapter 574 comprises an annular elongated cylindrical member having, on the exterior thereof, first cylindrical surface 576 having, in turn, wrenching flats 578 therein, second cylindrical surface 580 having, in turn, annular recess 582 therein containing seal means 584 therein, and threaded portion 586 and, on the interior thereof, threaded bore 588 which releasably, threadedly engages threaded portion 562 of lower lug mandrel 550, first cylindrical bore 590 and second cylindrical bore 592.

The upper mandrel extension 594 comprises an annular, elongated cylindrical member having; on one end thereof, a plurality of recesses 596 therein to allow fluid communication from the interior of the mandrel extension to the exterior thereof; on the exterior thereof, first cylindrical surface 598, a plurality of recesses 600 therein communicating first cylindrical surface 598 with second cylindrical surface 602; and, on the interior thereof, first cylindrical bore 604 which receives a portion of inner packer portion mandrel 114 therein, bore 604 having, in turn, annular recess 606 therein containing seal means 608 therein and second cylindrical bore 610.

Figure 2F:
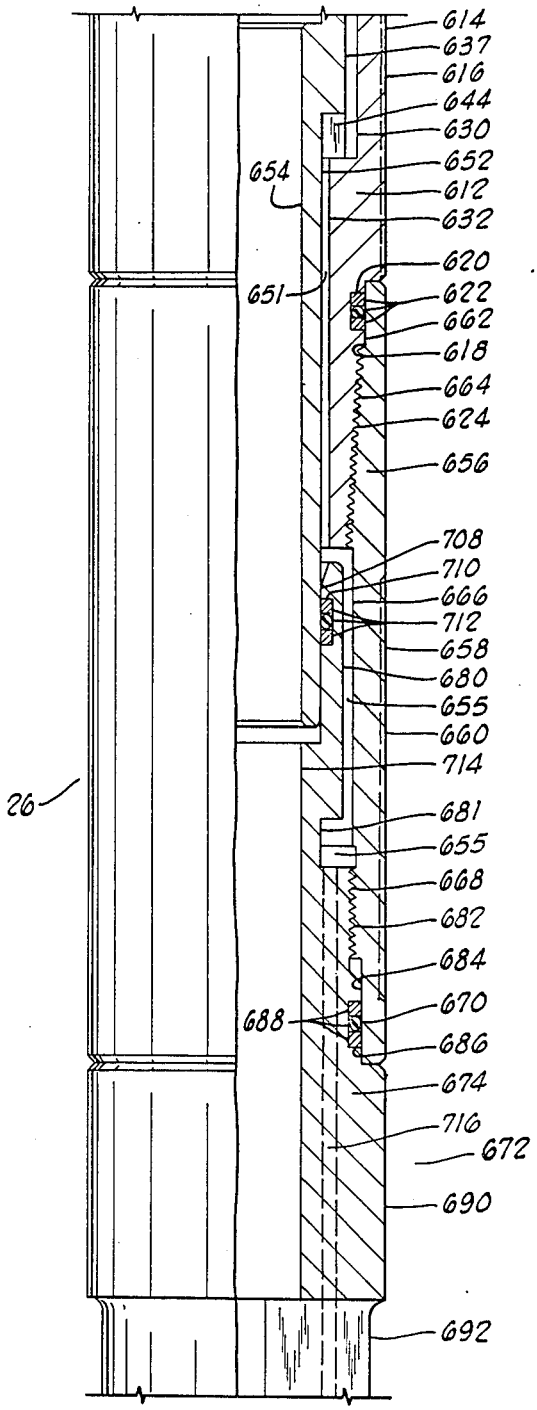

Referring to FIGS. 2E and 2F, the upper extension case 612 comprises an annular elongated cylindrical member having, on the exterior thereof, first cylindrical surface 614 having, in turn, wrenching flats 616 therein, second cylindrical surface 618 having, in turn, annular recess 620 therein containing seal means 622 therein and threaded portion 624 and, on the interior thereof, first cylindrical bore 626, threaded bore 628, second cylindrical bore 630, and third cylindrical bore 632.

Again referring to FIGS. 2E and 2F, the middle mandrel extension 634 comprises an annular elongated annular member having, on one end thereof; a plurality of recesses 636 therein to allow fluid communication from the interior of the mandrel extension to the exterior thereof; on the exterior thereof, cylindrical surface 636; on the interior thereof, cylindrical bore 638 having, in turn, annular recess 640 therein containing seal means 642 therein sealingly engaging second cylindrical surface 602 of upper mandrel extension 594; and, on the other end thereof, a plurality of recesses 644 therein to allow fluid communication from the interior of the mandrel extension to the exterior thereof.

Referring to FIG. 2F, the lower mandrel extension 650 comprises an annular, elongated cylindrical member having cylindrical exterior surface 652 and cylindrical bore 654 therethrough.

The lower extension case 656 comprises an annular elongated cylindrical surface 658 having, in turn, wrenching flats 660 therein and, on the interior thereof, first cylindrical bore 662, first threaded bore 664, second cylindrical bore 666, second threaded bore 668 and third cylindrical bore 670.

Figure 2G:
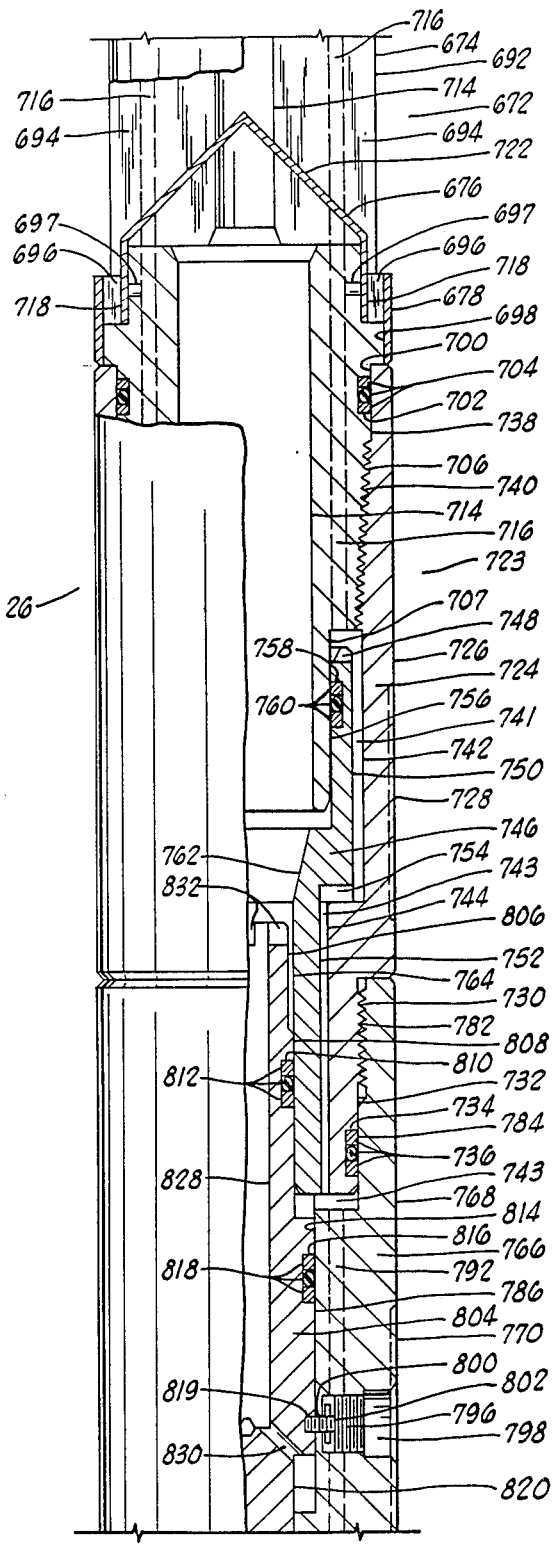

Referring to FIGS. 2F and 2G, the deflecting port adapter assembly 672 comprises port adapter 674, deflector 676 and deflector retainer 678.

The port adapter 674 comprises an annular elongated cylindrical member having, on the exterior thereof, first cylindrical surface 680, second cylindrical surface 681, first threaded portion 682 which releasably, threadedly engages second threaded bore 668 of lower extension case 656, third cylindrical surface 684 having, in turn, annular recess 686 therein containing seal means 688 therein, fourth cylindrical surface 690, fifth cylindrical surface 692 having, in turn, a plurality of elongated, generally rectangular in shape ports 694 therein extending through the port adapter 674 to allow fluid communication from the exterior thereof to the interior thereof and two recesses 696 and two recesses 697 therein located 180° from each other, sixth cylindrical surface 698, seventh cylindrical surface 700 having, in turn, annular recess 702 therein containing seal means 704 therein, second threaded portion 706, and eighth cylindrical surface 707 and, on the interior thereof, cylindrical bore 708, which slidingly engages surface 652 of lower mandrel extension 650, having, in turn, annular recess 710 therein containing seal means 712 therein and cylindrical bore 714. The port adapter 674 further includes a plurality of axial passageways 716 extending from the area between second cylindrical surface 681 and first threaded portion 682 to the area between second threaded portion 706 and eighth cylindrical surface 707.

Referring to FIG. 2G, the deflector 676 comprises a rectangular strip of readily frangible material formed into a V-shape having on the ends 718 thereof retained within recesses 696 of port adapter 674 while projections 720 are retained within recesses 697 of the port adapter and having the V-portion 722 extending through ports 694 in port adapter 674 into bore 714 blocking a portion thereof.

The deflector retainer 678 comprises an annular cylindrical member which is retained on sixth cylindrical surface 698 of port adapter 674 by means of a slight friction fit.

Figure 2H:
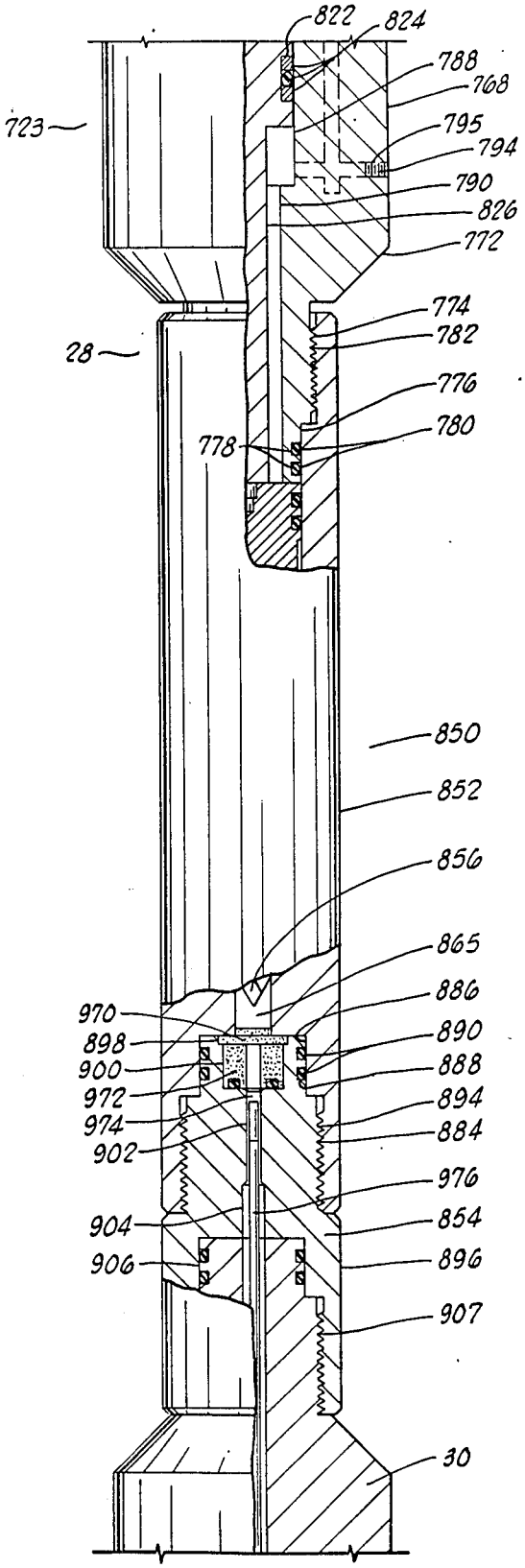

Referring to FIGS. 2G and 2H, the firing head actuating assembly 723 comprises top sealing bar adapter 724, top sealing bar mandrel 746, lower sealing bar adapter 766 and pressure balanced piston bar 804.

Referring to FIG. 2G, the top sealing bar adapter 724 comprises an annular elongated cylindrical member having, on the exterior thereof, first cylindrical surface 726 having, in turn, wrenching flats 728 therein, threaded portion 730, and second cylindrical surface 732 having, in turn, annular recess 734 therein containing seal means 736 therein and, on the interior thereof, first cylindrical surface 738, threaded bore 740 which releasably, threadedly engages second threaded portion 708 of port adapter 674, second cylindrical bore 742 and third cylindrical bore 744.

The top sealing bar mandrel 746 comprises an annular elongated cylindrical member having; on one end thereof, a plurality of recesses 748 therethrough to allow fluid communication thereacross; on the exterior thereof first cylindrical surface 750 having, in turn, a plurality of recesses 754 therein to allow fluid communication between first cylindrical surface 750 and second cylindrical surface 752; and, on the interior thereof, first cylindrical bore 756 which slidably engages eighth cylindrical surface 707 of port adapter 674 having, in turn, annular recess 758 therein containing seal means 760 therein, frusto-conical annular bore 762 and second cylindrical bore 764.

Referring to FIGS. 2G and 2H, the lower sealing bar adapter 766 comprises an annular elongated cylindrical member having, on the exterior thereof, first cylindrical surface 768 having, in turn, wrenching flats 770 therein, frusto-conical surface 772 and threaded surface 774, and second cylindrical surface 776 having, in turn, annular recesses 778 therein each containing seal means 780 therein and, on the interior thereof, threaded bore 782 which releasably, threadedly engages threaded portion 730 of top sealing bar adapter 724, first cylindrical bore 784, second cylindrical bore 786, third cylindrical bore 788 and fourth cylindrical bore 790. The lower sealing bar adapter 766 further comprises a plurality of axial passageways 792 extending from the area between bore 784 and bore 786 to transverse passageways 794 having plugs 795 in the outer end therefore which extend between bore 788 and first cylindrical surface 768, a bore 796 which releasably contains a plug 798 therein, and a bore 800 which contains a portion of shear pin 802 therein.

The pressure balanced piston bar 804 comprises an elongated cylindrical member having, on the exterior thereof, a first cylindrical surface 806, second cylindrical surface 808 having, in turn, annular recess 810 therein containing seal means 812 therein, third cylindrical surface 814 having, in turn, annular recess 816 therein containing seal means 818 therein and annular recess 819 which receives a portion of shear pin 802 therein, fourth cylindrical surface 820 having, in turn, annular recess 822 therein containing seal means 824 therein and fifth cylindrical surface 826 and, on the interior thereof, cylindrical bore 828 having, in turn, a plurality of passageways 830 extending therefrom to the area between third cylindrical surface 814 and fourth cylindrical surface 820. The piston bar 804 further includes a plurality of recesses 832 in one end thereof.

Referring to FIG. 2H, the firing assembly 850 is shown. The firing assembly 850 comprises housing 852, adapter 854, piston 856, primary explosive charge 970 and booster charge 972.

The adapter 854 comprises an elongated annular cylindrical member having, on the exterior thereof, first cylindrical surface 886 having, in turn, a plurality of annular recesses 888 therein containing seal means 890 therein, threaded portion 894 which releasably, threadedly engages threaded bore 884 of housing 852 and second cylindrical surface 896 and, on the interior thereof, first cylindrical bore 898, second cylindrical bore 900, third cylindrical bore 902, fourth cylindrical bore 904, fifth cylindrical bore 906 and threaded bore 907.

The piston 856 comprises an elongated cylindrical member. The piston 856 is held in an upper first position to prevent the movement thereof until desired at the time of actuation by any suitable, as well known means, such as shear pins, collet members, etc.

The primary explosive charge 970 is received in first cylindrical bore 898 of adapter 854. The charge 970 may be of any suitable type which supplies enough energy to initiate an explosive reaction in booster charge 972.

The booster charge 972 is received within second cylindrical bore 900 of adapter 854. The booster charge 972 may be of any suitable type capable of supplying enough explosive energy to initiate an explosive reaction in an explosive blasting cap 974 crimped to the explosive detonating cord 976 of perforating device 30 which is releasably, threadedly secured to threaded bore 907 of adapter 854.

Figure 3A:
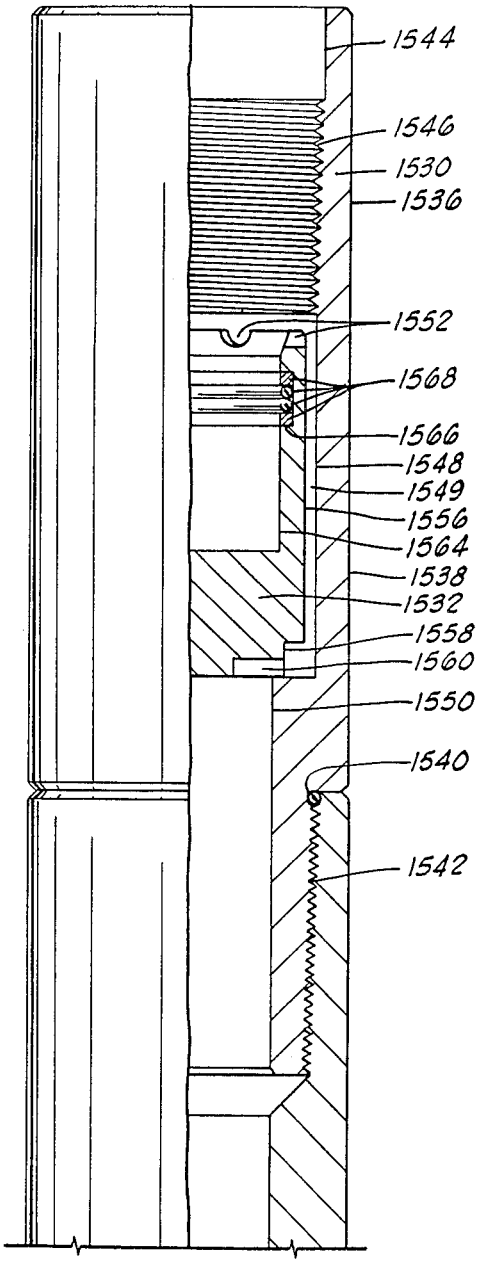
FIGS. 3A through 3B are a partial cross-sectional view of an alternative embodiment of the tubing conveyed completion system of the present invention.
Figure 3B:
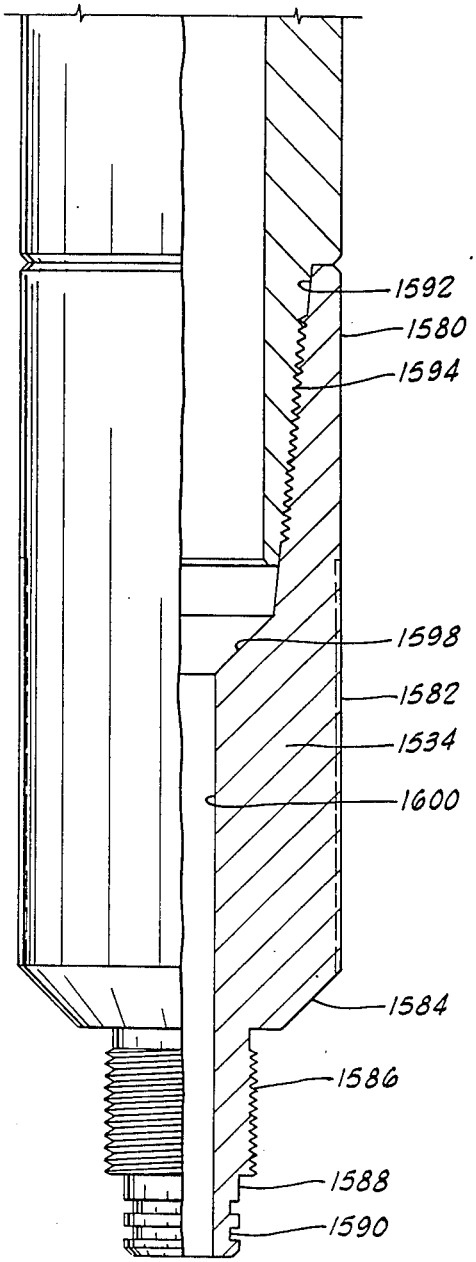

Referring to FIGS. 3A and 3B, an alternative embodiment of a portion of the tubing conveyed completion system 50 is shown. To use the internal porting adapter 1530, internal porting adapter plug 1532 and bottom adapter 1534 the top sealing bar adapter 724, bottom sealing bar adapter 766, top sealing bar mandrel 746 and balanced pressure piston 804 are deleted from the completion system 50.

Referring to FIG. 3A, the internal porting adapter 1530 comprises an annular elongated cylindrical member having, on the exterior thereof, first cylindrical surface 1536 having, in turn, wrenching flats 1538 therein, annular seal recess 1540 and threaded portion 1542 and on the interior thereof, first cylindrical bore 1544, threaded bore 1546 which releasably, threadedly engages second threaded portion 706 of port adapter 674, second cylindrical bore 1548 and third cylindrical bore 1550.

The internal porting adapter plug 1532 comprises an elongated circular member having, on one end, a plurality of passageways 1552 to allow fluid communication across end 1554; on the exterior thereof, first cylindrical surface 1556, second cylindrical surface 1558 having, in turn, a plurality of recesses 1560 therein to allow fluid communication from the exterior of plug 1532 across a portion of end 1562 thereof; and, on the interior thereof blind cylindrical bore 1564, which slidingly receives eighth cylindrical surface 707 of port adapter 674, having, in turn, annular recess 1566 therein containing seal means 1568 therein.

If it is desired to space internal porting adapter 1530 from bottom adapter 1534, drill pipe (shown in phantom) may be used.

Referring to FIG. 3*b*, the bottom adapter 1534 is shown. The bottom adapter comprises an annular elongated cylindrical member having, on the exterior thereof, first cylindrical surface 1580 having, in turn, wrenching flats 1582 therein frusto-conical surface 1584, threaded portion 1586 which mates with first threaded bore 872 of housing 852, and second cylindrical surface 1588 having, in turn, a plurality of annular recesses 1590 therein for containing seal means therein and, on the interior thereof, first frusto-conical annular surface 1592, threaded bore 1594 which mates either with threaded portion 1542 of internal porting adapter 1530 or the pin portion of a drill pipe conduit, second frusto-conical annular surface 1596, third frusto-conical surface 1598 and cylindrical bore 1600.

Operation of the Preferred Embodiment

Referring to FIGS. 2A through 2H, the tubing conveyed completion system 50 is operated as follows.

When it is desired to perforate the casing 12 and into the earth 1 when the completion system 50 is in the well bore, it is first necessary to set the packer portion 24, to isolate one portion of the well bore from another. To set the packer portion 24 which is shown in FIGS. 2A through 2D, apply right hand torque to the completion system to position lug 528 in automatic J-shaped aperture 494 and set weight down on the completion system 50. As weight is set down, when the upper packer mandrel 114 moves downwardly causing seal 284 to engage face seal sleeve 342 and seal ports 244 in bypass case 240, since the drag blocks 466 are biased into engagement with the casing 12, as weight is set down on the system 50 lug 528 moves in automatic J-shaped aperture 494 of drag block sleeve 464 causing slips 406 to move upwardly and outwardly on slip body 404 thereby engaging casing 12 to prevent further downward movement of the completion system 50 in the casing 12. As weight is continued to be set down on the completion system 50 after the slips 406 engage the casing 12 continued downward movement causes packer elements 380 to be compressed between slip body 404 which is now stationery due to slips 406 engaging the casing 12 and the upper shoe 354 which is moving downwardly because it is connected via bypass case 240 upper mandrel 116, coupling 62 and nipple 60 to the tubing 14. After the desired amount of weight has been set on the packer portion 24, if fluid pressure below the packer portion 24 tries to force the packer portion 24 upwardly, the fluid will flow through ports 430 into annular chamber 429 upwardly, through annular chamber 321 between seal retainer 286 and center packer mandrel 118, through the annular chamber 283 between balancing coupling body 282 and center packer mandrel 118, through passageways 308 and into annular chamber 181 thereby forcing hydraulic slips 200 into engagement with casing 12.

After the packer portion 24 is set, when it is desired to actuate firing assembly 850 to actuate the perforating gun 30 by means of hydraulic fluid pressure in the annulus 18 between the tubing 14 and casing 12 above the packer portion 24, the fluid pressure in the annulus 18 is increased thereby causing the fluid pressure to be transferred by the fluid through apertures 96 in coupling 62 into annular cavity 112, through annular cavity 112, through cavity 115 between inner packer portion mandrel 114 and upper packer mandrel 116, center packer mandrel 330, lower mandrel 472, and lower lug mandrel 550, through recesses 596 in upper mandrel extension 594 though annular chamber 591, through recesses 600, through annular chamber 575, through recesses 636, through annular chamber 631, through recesses 644, through annular chamber 651, through annular chamber 655, through passageways 716, through recesses 748, through annular chamber 741, through recesses 754, through annular chamber 743, through passageways 792, through bore 788 and bore 790 to bear against the top or upper surface of firing assembly 850.

When the fluid pressure causing forces acting on the piston 856 is great enough, since fluid pressure causing forces acting on piston 856 is greater than the atmospheric fluid pressure trapped in cavity 865 therebelow and great enough to overcome the suitable means holding the piston 856 in an upper first position, this causes the rapid downward movement of the piston 856 striking primary detonator 970 causing the explosing thereof which, in turn, causes the explosion of booster charge 972 which, in turn, detonates explosive cap 974 which, in turn, detonates detonating cord 976 which, finally, detonates the perforating charges in the perforating gun 30.

After the casing 12 has been perforated along with the area of the well bore surrounding the casing, formation fluids flow from the earth 1 into the well bore past perforating gun 30, upwardly along a portion of the perforating system 50 until the fluids flow into apertures 694 in port adapter 674, into and through bore 714 of the deflecting port adapter assembly 672, through bore 654 of lower mandrel extension 650, through second bore 610 of the upper mandrel extension 594, through bore 122 of inner packer portion mandrel 114, and through first cylindrical bore 82 into the tubing string 14 to the surface of the earth 1.

An alternative method of firing the completion system 50 of the present invention comprises the use of a sinker drop bar dropped down the tubing string 14 to cause the actuation of the firing assembly 850.

When a sinker drop bar is dropped down the tubing string, the bar falls down the tubing string until it impacts the deflector 676 fracturing the same into several pieces as the deflector 676 is made of readily frangible material at which point the bar continues its downward movement impacting pressure balanced piston bar 804. When pressure balanced piston bar 804 is impacted, shear pin 802 retaining bar 804 in position in lower sealing bar adapter 766 is sheared thereby allowing bar 804 move downwardly in adapter 766 until it strikes the firing assembly 850.

This causes the piston 856 to impact and detonate primary detonator 970 causing the explosion thereof which, in turn, causes the explosion of booster charges 972 which, in turn, detonates explosive cap 974 which, in turn, detonates the detonating cord 976 which, finally, detonates the perforating charges in the perforating gun 30.

Referring to FIGS. 2A through 2H and FIGS. 3A and 3B, when the internal porting adapter 1530, internal porting adapter plug 1532 and bottom adapter 1534 in place of the top sealing bar adapter 724, bottom sealing bar adapter 766, top sealing bar mandrel 746 and balanced pressure piston 804 in the completion system 50, the operation of the system 50 is as follows.

When using the internal porting adapter 1530, internal porting adapter plug 1532 and bottom adapter 1534, the firing assembly 850 may only be actuated by fluid pressure increases in the annulus 18 between the tubing 14 and casing 12 above the packer portion 24.

To actuate the firing assembly 850 when using the internal porting adapter 1530, internal porting adapter plug 1532 and bottom adapter 1534, the fluid pressure in the annulus 18 between the tubing 14 and casing 12 above the packer portion 24, after the packer portion 24 is set, is increased thereby causing fluid pressure to be transferred by the fluid through the completion system 50 in the same manner as described hereinbefore except that, rather than flowing into and through annular chamber 741, recesses 754, annular chamber, through bore 788 and bore 790 into firing system 850, the fluid pressure flows into and through annular chamber 1549 from passageways 716, through recesses 1560, through bore 1550, into and through the bore of any drill pipe extension connected to internal porting adapter 1530 and, finally, through frusto-conical annular surfaces 1596 and 1598 into bore 1600 which communicates with piston 856 of firing assembly 850 to actuate the same in the same manner as that described hereinbefore through the application of fluid pressure.

As can be readily seen from the foregoing specification, the present invention offers significant advantages over the prior art tubing conveyed completion systems, such as having an integral packer portion, port, and actuation portions actuated by either a sinker drop bar or hydraulically by fluid pressure.

It will be appreciated by those skilled in the art that additions, deletions, modifications and substitutions, or other changes not specifically described herein may be made which fall within the purview of the appended claims.

What is claimed as new and desired to be secured by Letters Patent is:

1. An improved tubing conveyed well perforating system comprising:
- a packer assembly portion;
- a port assembly portion releasably connected to the packer assembly portion, the port assembly including:
  - a lower adapter;
  - an upper mandrel extension having a portion thereof retained within the lower adapter;
  - an upper extension case releasably secured to the lower adapter;
  - a middle mandrel extension slidably, sealingly engaging a portion of the upper mandrel extension therein;
  - a lower extension case releasably secured to the upper extension case; and
  - a deflecting port adapter assembly releasably secured to the lower extension case, the deflecting port adapter assembly including:
    - a port adapter releasably secured to the lower extension case having a plurality of ports therein and a bore therethrough;
    - a deflector having a portion thereof blocking a portion of the bore of the port adapter and having the ends thereof releasably secured to the port adapter; and
    - a deflector retainer releasably secured to the port adapter releasably retaining the ends of the deflector thereon; and
- an actuating assembly portion releasably connected to the port assembly portion, the actuating assembly portion including:
  - a firing head actuating assembly.

2. The perforating system of claim 1 wherein the packer assembly portion comprises:
- a nipple;
- a coupling releasably connected to the nipple;
- an inner packer portion mandrel slidably, sealingly received within the nipple;
- an upper packer mandrel releasably secured to the coupling;
- a hydraulic slip assembly slidably retained on the upper packer mandrel;
- a bypass case releasably secured to the hydraulic slip assembly;
- a floating piston slidably retained within the bypass case;
- a balancing coupling assembly releasably secured to the upper packer mandrel;
- a center packer mandrel releasably secured to the balancing coupling assembly;
- an upper shoe;
- a face seal sleeve retained within the upper shoe;
- a packer mandrel slidably retained within the upper shoe;
- packer elements slidably retained upon the packer mandrel;
- a mechanical slip body assembly releasably secured to the packer mandrel; and
- a drag block assembly releasably secured to one end of the center packer mandrel.

3. The perforating system of claim 2 wherein the hydraulic slip assembly includes:
- a hydraulic slip body having a plurality of apertures therein;
- a plurality of hydraulic slips retained within the plurality of apertures in the hydraulic slip body;
- a plurality of hydraulic slip retractor springs biasing the plurality of hydraulic slips in a retracted position within the hydraulic slip body; and
- a plurality of hydraulic slip hold down straps retaining the plurality of hydraulic slip retractor springs within the hydraulic slip body;

balancing coupling assembly includes:
- a balancing coupling body;
- a seal; and
- a seal retainer retaining the seal on the balancing coupling body;

mechanical slip body assembly including:
- a slip body;
- a plurality of mechanical slips slidably retained on the slip body; and
- a split ring retainer retaining the plurality of slips slidably disposed on the slip body; and drag block assembly including:
- an adapter releasably secured to the center packer mandrel;
- a drag block sleeve having a portion thereof engaging a portion of the split ring retainer of the mechanical slip body assembly and having a plurality of apertures therein;
- a plurality of drag blocks retained within the plurality of apertures in the drag block sleeve;
- a plurality of drag block springs retained within the plurality of apertures in the drag block sleeve, each spring having a portion thereof abutting a portion of an individual drag block and a portion thereof abutting the drag block sleeve;
- a drag block keeper releasably secured to the drag block sleeve having a portion thereof engaging the plurality of drag blocks; and
- a lower mandrel releasably secured to the adapter and having the drag block sleeve slidable thereon.

4. The perforating system of claim 1 wherein the firing head actuating assembly includes:
- a top sealing bar adapter releasably secured to the port assembly portion;
- a top sealing bar mandrel retained within the top sealing bar adapter;
- a lower sealing bar adapter releasably secured to the top sealing bar adapter; and
- a pressure balanced piston slidably, sealingly, releasably retained within a portion of the top sealing bar mandrel and lower sealing bar adapter.

5. The perforating system of claim 1 wherein the firing head actuating assembly includes:
- an internal porting adapter having a bore therethrough;
- an internal porting adapter plug slidably retained within the bore of the internal porting adapter; and
- a bottom adapter.

6. The perforating system of claim 1 wherein: .

the packer assembly portion includes:
- a nipple;
- a coupling releasably connected to the nipple;

an inner packer portion mandrel slidably, sealingly received within the nipple;
an upper packer mandrel releasably secured to the coupling;
a hydraulic slip assembly slidably retained on the upper packer mandrel;
a bypass case releasably secured to the hydraulic slip assembly;
a floating piston slidably retained within the bypass case;
a balancing coupling assembly releasably secured to the upper packer mandrel;
a center packer mandrel releasably secured to the balancing coupling assembly;
an upper shoe;
a face seal sleeve retained within the upper shoe;
a packer mandrel slidably retained within the upper shoe;
packer elements slidably retained upon the packer mandrel;
a mechanical slip body assembly releasably secured to the packer mandrel; and
a drag block assembly releasably secured to one end of the center packer mandrel;
the port assembly portion includes:
a lower adapter;
an upper mandrel extension having a portion thereof retained within the lower adapter;
an upper extension case releasably secured to the lower adapter;
a middle mandrel extension slidably, sealingly engaging a portion of the upper mandrel extension therein;
a lower extension case releasably secured to the upper extension case; and
a deflecting port adapter assembly releasably secured to the lower extension case; and
the firing head actuating assembly includes:
a top sealing bar adapter releasably secured to the port assembly portion;
a top sealing bar mandrel retained within the top sealing bar adapter;
a lower sealing bar adapter releasably secured to the top sealing bar adapter; and
a pressure balanced piston slidably, sealingly, releasably retained within a portion of the top sealing bar mandrel and lower sealing bar adapter.

7. The perforating system of claim 6 wherein:
the hydraulic slip assembly includes:
a hydraulic slip body having a plurality of apertures therein;
a plurality of hydraulic slips retained within the plurality of apertures in the hydraulic slip body;
a plurality of hydraulic slip retractor springs biasing the plurality of hydraulic slips in a retracted position within the hydraulic slip body; and
a plurality of hydraulic slip hold down straps retaining the plurality of hydraulic slip retractor springs within the hydraulic slip body;
the balancing coupling assembly includes:
a balancing coupling body;
a seal; and
a seal retainer retaining the seal on the balancing coupling body;
the mechanical slip body assembly including:
a slip body;
a plurality of mechanical slips slidably retained on the slip body; and
a split ring retainer retaining the plurality of slips slidably disposed on the slip body; and
drag block assembly including:
an adapter releasably secured to the center packer mandrel;
a drag block sleeve having a portion thereof engaging a portion of the split ring retainer of the mechanical slip body assembly and having a plurality of apertures therein;
a plurality of drag blocks retained within the plurality of apertures in the drag block sleeve;
a plurality of drag block springs retained within the plurality of apertures in the drag block sleeve, each spring having a portion thereof abutting a portion of an individual drag block and a portion thereof abutting the drag block sleeve;
a drag block keeper releasably secured to the drag block sleeve having a portion thereof engaging the plurality of drag blocks; and
a lower mandrel releasably secured to the adapter and having the drag block sleeve slidable thereon.

8. The perforating system of claim 7 wherein the deflecting port adapter assembly includes:
a port adapter releasably secured to the lower extension case having a plurality of ports therein and a bore therethrough;
a deflector having a portion thereof blocking a portion of the bore of the port adapter and having the ends thereof releasably secured to the port adapter; and
a deflector retainer releasably secured to the port adapter releasably retaining the ends of the deflector thereon.

9. The perforating system of claim 1 wherein:
the packer assembly portion includes:
a nipple;
a coupling releasably connected to the nipple;
an inner packer portion mandrel slidably, sealingly received within the nipple;
an upper packer mandrel releasably secured to the coupling;
a hydraulic slip assembly slidably retained on the upper packer mandrel;
a bypass case releasably secured to the hydraulic slip assembly;
a floating piston slidably retained within the bypass case;
a balancing coupling assembly releasably secured to the upper packer mandrel;
a center packer mandrel releasably secured to the balancing coupling assembly;
an upper shoe;
a face seal sleeve retained within the upper shoe;
a packer mandrel slidably retained within the upper shoe;
packer elements slidably retained upon the packer mandrel;
a mechanical slip body assembly releasably secured to the packer mandrel; and
a drag block assembly releasably secured to one end of the center packer mandrel;
the port assembly portion includes:
a lower adapter;
an upper mandrel extension having a portion thereof retained within the lower adapter;

an upper extension case releasably secured to the lower adapter;

a middle mandrel extension slidably, sealingly engaging a portion of the upper mandrel extension therein;

a lower extension case releasably secured to the upper extension case; and a deflecting port adapter assembly releasably secured to the lower extension case; and the firing head actuating assembly includes:

an internal porting adapter having a bore therethrough; and an internal porting adapter plug slidably retained within the bore of the internal porting adapter; and a bottom adapter.

10. An improved tubing conveyed well perforating system comprising:

a packer assembly portion including:

a nipple;

a coupling releasably connected to the nipple;

an inner packer portion mandrel slidably, sealingly received within the nipple;

an upper packer mandrel releasably secured to the coupling;

a hydraulic slip assembly slidably retained on the upper packer mandrel;

a bypass case releasably secured to the hydraulic slip assembly;

a floating piston slidably retained within the bypass case;

a balancing coupling assembly releasably secured to the upper packer mandrel;

a center packer mandrel releasably secured to the balancing coupling assembly;

an upper shoe;

a face seal sleeve retained within the upper shoe;

a packer mandrel slidably retained within the upper shoe;

packer elements slidably retained upon the packer mandrel;

a mechanical slip body assembly releasably secured to the packer mandrel; and a drag block assembly releasably secured to one end of the center packer mandrel;

a port assembly portion releasably connected to the packer assembly portion, the port assembly portion including:

a lower adapter;

an upper mandrel extension having a portion thereof retained within the lower adapter;

an upper extension case releasably secured to the lower adapter;

a middle mandrel extension slidably, sealingly engaging a portion of the upper mandrel extension therein;

a lower extension case releasably secured to the upper extension case; and a deflecting port adapter assembly releasably secured to the lower extension case; and an actuating assembly portion releasably connected to the port assembly portion, the actuating assembly portion including:

a firing head actuating assembly including:

a top sealing bar adapter releasably secured to the port assembly portion;

a top sealing bar mandrel retained within the top sealing bar adapter;

a lower sealing bar adapter releasably secured to the top sealing bar adapter; and a pressure balanced piston slidably, sealingly, releasably retained within a portion of the top sealing bar mandrel and lower sealing bar adapter.

11. The perforating system of claim 10 wherein:

the hydraulic slip assembly includes:

a hydraulic slip body having a plurality of apertures therein;

a plurality of hydraulic slips retained within the plurality of apertures in the hydraulic slip body;

a plurality of hydraulic slip retractor springs biasing the plurality of hydraulic slips in a retracted position within the hydraulic slip body; and a plurality of hydraulic slip hold down straps retaining the plurality of hydraulic slip retractor springs within the hydraulic slip body;

the balancing coupling assembly includes:

a balancing coupling body;

a seal; and a seal retainer retaining the seal on the balancing coupling body;

the mechanical slip body assembly including:

a slip body;

a plurality of mechanical slips slidably retained on the slip body; and a split ring retainer retaining the plurality of slips slidably disposed on the slip body; and the drag block assembly including:

an adapter releasably secured to the center packer mandrel;

a drag block sleeve having a portion thereof engaging a portion of the split ring retainer of the mechanical slip body assembly and having a plurality of apertures therein;

a plurality of drag blocks retained within the plurality of apertures in the drag block sleeve;

a plurality of drag block springs retained within the plurality of apertures in the drag block sleeve, each spring having a portion thereof abutting a portion of an individual drag block and a portion thereof abutting the drag block sleeve;

a drag block keeper releasably secured to the drag block sleeve having a portion thereof engaging the plurality of drag blocks; and a lower mandrel releasably secured to the adapter and having the drag block sleeve slidable thereon.

12. The perforating system of claim 11 wherein the deflecting port adapter assembly includes:

a port adapter releasably secured to the lower extension case having a plurality of ports therein and a bore therethrough;

a deflector having a portion thereof blocking a portion of the bore of the port adapter and having the ends thereof releasably secured to the port adapter; and a deflector retainer releasably secured to the port adapter releasably retaining the ends of the deflector thereon.

13. An improved tubing conveyed well perforating system comprising:

a packer assembly portion including:

a nipple;

a coupling releasably connected to the nipple;

an inner packer portion mandrel slidably, sealingly received within the nipple;

an upper packer mandrel releasably secured to the coupling;
a hydraulic slip assembly slidably retained on the upper packer mandrel;
a bypass case releasably secured to the hydraulic slip assembly;
a floating piston slidably retained within the bypass case;
a balancing coupling assembly releasably secured to the upper packer mandrel;
a center packer mandrel releasably secured to the balancing coupling assembly;
an upper shoe;
a face seal sleeve retained within the upper shoe;
a packer mandrel slidably retained within the upper shoe;
packer elements slidably retained upon the packer mandrel;
a mechanical slip body assembly releasably secured to the packer mandrel; and
a drag block assembly releasably secured to one end of the center packer mandrel;
a port assembly portion releasably connected to the packer assembly portion, the port assembly portion including:
a lower adapter;
an upper mandrel extension having a portion thereof retained within the lower adapter;
an upper extension case releasably secured to the lower adapter;
a middle mandrel extension slidably, sealingly engaging a portion of the upper mandrel extension therein;
a lower extension case releasably secured to the upper extension case; and
a deflecting port adapter assembly releasably secured to the lower extension case; and
an actuating assembly portion releasably connected to the port assembly portion, the actuating assembly portion including:
a firing head actuating assembly including:
a top sealing bar adapter releasably secured to the port assembly portion;
a top sealing bar mandrel retained within the top sealing bar adapter;
a lower sealing bar adapter releasably secured to the top sealing bar adapter.

14. The perforating system of claim 13 wherein the hydraulic slip assembly includes:
a hydraulic slip body having a plurality of apertures therein;
a plurality of hydraulic slips retained within the plurality of apertures in the hydraulic slip body;
a plurality of hydraulic slip retractor springs biasing the plurality of hydraulic slips in a retracted position within the hydraulic slip body; and
a plurality of hydraulic slip hold down straps retaining the plurality of hydraulic slip retractor springs within the hydraulic slip body;
balancing coupling assembly includes:
a balancing coupling body;
a seal; and
a seal retainer retaining the seal on the balancing coupling body; mechanical slip body assembly including:
a slip body;
a plurality of mechanical slips slidably retained on the slip body; and
a split ring retainer retaining the plurality of slips slidably disposed on the slip body; and
drag block assembly including:
an adapter releasably secured to the center packer mandrel;
a drag block sleeve having a portion thereof engaging a portion of the split ring retainer of the mechanical slip body assembly and having a plurality of apertures therein;
a plurality of drag blocks retained within the plurality of apertures in the drag block sleeve;
a plurality of drag block springs retained within the plurality of apertures in the drag block sleeve, each spring having a portion thereof abutting a portion of an individual drag block and a portion thereof abutting the drag block sleeve;
a drag block keeper releasably secured to the drag block sleeve having a portion thereof engaging the plurality of drag blocks; and
a lower mandrel releasably secured to the adapter and having the drag block sleeve slidable thereon.

15. The perforating system of claim 14 wherein the deflecting port adapter assembly includes:
a port adapter releasably secured to the lower extension case having a plurality of ports therein and a bore therethrough;
a deflector having a portion thereof blocking a portion of the bore of the port adapter and having the ends thereof releasably secured to the port adapter; and
a deflector retainer releasably secured to the port adapter releasably retaining the ends of the deflector thereon.

* * * * *